United States Patent [19]

Barnes

[11] 4,079,555

[45] Mar. 21, 1978

[54] AUTOMATIC COLOR GUARD FLAGPOLE

[75] Inventor: James H. Barnes, Nortonville, Ky.

[73] Assignee: The Raymond Lee Organization, Inc., New York, N.Y.

[21] Appl. No.: 764,353

[22] Filed: Jan. 31, 1977

[51] Int. Cl.[2] ..... E04H 12/32

[52] U.S. Cl. ..... 52/111; 52/1; 52/114; 116/173

[58] Field of Search ..... 52/1, 120, 114; 116/173-175

[56] References Cited

U.S. PATENT DOCUMENTS

| | | | |
|---|---|---|---|
| 1,359,818 | 11/1920 | Marr | 116/173 |
| 1,896,832 | 2/1933 | Wiley | 116/173 |
| 2,441,875 | 5/1948 | Faber | 116/173 |
| 3,675,616 | 7/1972 | McInnis | 116/173 |
| 3,737,749 | 6/1973 | Schmit | 116/173 |
| 3,996,882 | 12/1976 | Martin | 116/173 |
| 4,010,577 | 3/1977 | Stalter | 52/1 |

FOREIGN PATENT DOCUMENTS

| | | | |
|---|---|---|---|
| 468,661 | 11/1928 | Germany | 116/173 |

*Primary Examiner*—Ernest R. Purser
*Assistant Examiner*—Henry Raduazo
*Attorney, Agent, or Firm*—Howard I. Podell

[57] ABSTRACT

A flagpole assembly for automatically displaying and furling a flag. The assembly is formed of a first hollow vertical slotted pole mounted concentrically inside a second slotted hollow pole with both poles mounted to a base. A cable, mounted on pulleys extends inside the first pole with the flag fixed to the cable, and extending through the slot of the first pole, and when displayed, extending through the slot of the second pole. The second pole is rotatably mounted to the base. A motor unit serves to wind the cable pulleys and rotate the second pole for furling or unfurling the flag, with associated sensors and limit switches serving to furl the flag during periods of darkness and periods of rain.

1 Claim, 4 Drawing Figures

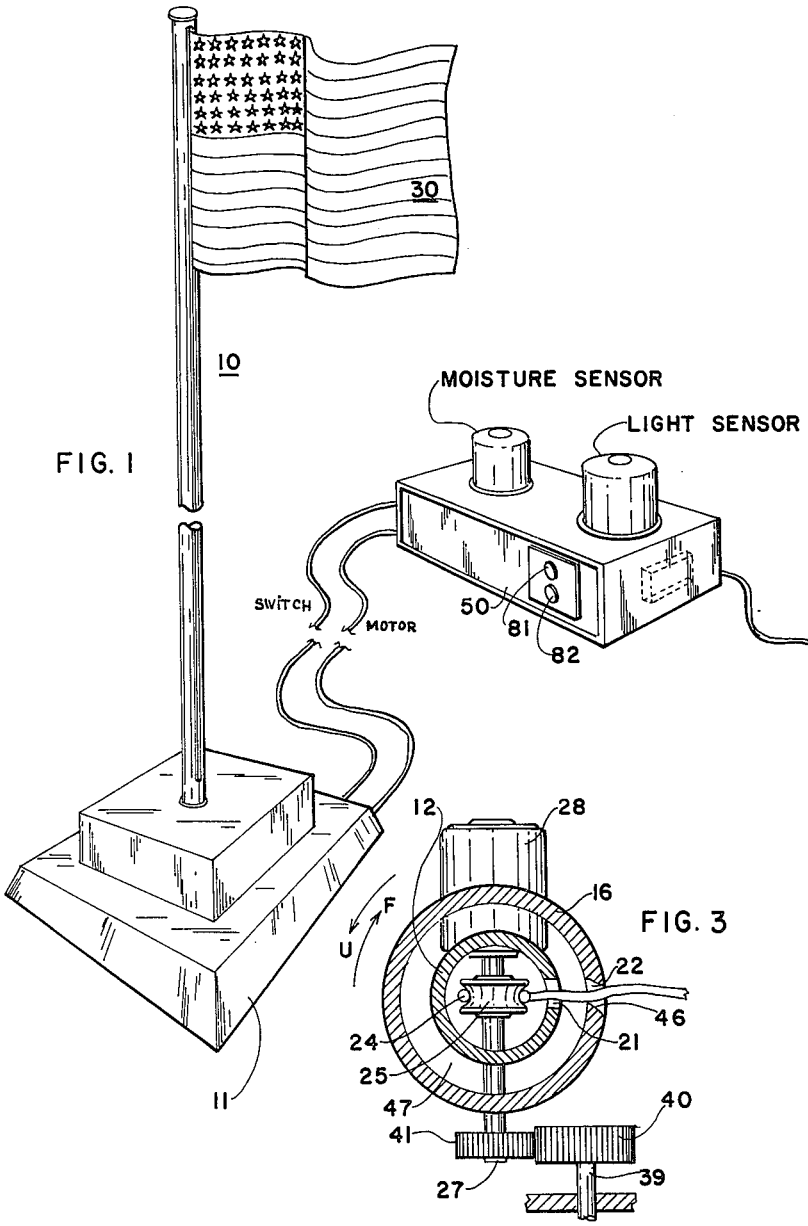
FIG. 1
FIG. 3
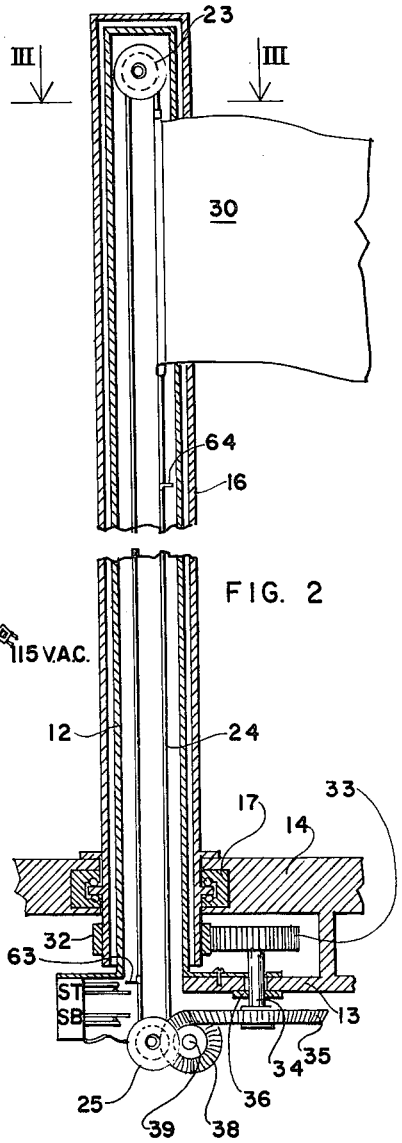
FIG. 2
FIG. 4
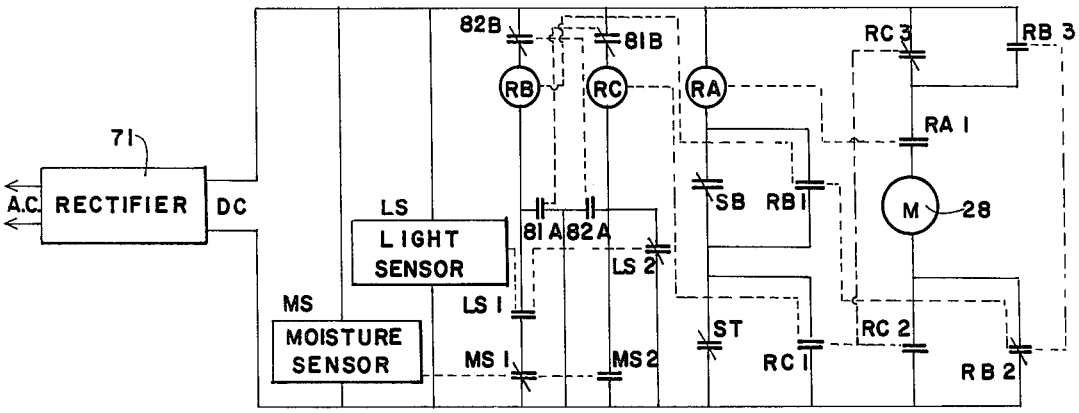

AUTOMATIC COLOR GUARD FLAGPOLE

SUMMARY OF THE INVENTION

My invention is a flagpole assembly for automatically displaying and furling a flag. The assembly is formed of a first hollow vertical slotted pole mounted concentrically inside a second slotted hollow pole with both poles mounted to a base. A cable, mounted on pulleys extends inside the first pole with the flag fixed to the cable, and extending through the slot of the first pole, and when displayed, extending through the slot of the second pole. The second pole is rotatably mounted to the base. A motor unit serves to wind the cable pulleys and rotate the second pole for furling or unfurling the flag, with associated sensors and limit switches serving to furl the flag during periods of darkness and periods of rain.

BRIEF DESCRIPTION OF THE DRAWINGS

The objects and features of the invention may be understood with reference to the following detailed descriptions of an illustrative embodiment of the invention, taken together with the accompanying drawings in which:

FIG. 1 is a perspective view of the invention;

FIG. 2 is a sectional view of the invention, taken in elevation;

FIG. 3 is a sectional view taken along line III—III of FIG. 2; and

FIG. 4 is a schematic diagram of the electric circuitry.

DESCRIPTION OF THE PREFERRED EMBODIMENT

Turning now descriptively to the drawings, in which similar reference characters denote similar elements throughout the several views, FIGS. 1–3 illustrate the automatic flagpole assembly 10 which is formed of a base unit 11 to which an inner hollow pole 12 is fixed by an internal wall 13 joined to the housing 14 of the base unit 11. An outer hollow pole 16 is concentrically mounted about inner pole 12 and rotatably mounted in bearing 17 fixed to housing 14. Through slots 21 and 22 run substantially the length of poles 12 and 16 respectively. A pulley 23 is rotatably mounted in the top section of pole 12 and joined by a continuous loop of cable 24 to a pulley 25 fixed to a shaft 27 of a motor 28 mounted in the base unit 11, with a flag 30 fastened to cable 24 so as to project in the unfurled condition through slots 21 and 22.

Outer pole 16 is fixed, at its lower end to a gear 32 meshed to a gear 33, with gear 33 fixed to a shaft 34 to which a bevel gear 35 is fixed and with shaft 34 rotatably mounted to housing wall 13 by a bearing 36. Bevel gear 35 is meshed to a bevel gear 38 on a shaft 39 internally rotatably mounted to the housing, with shaft 39 drivin by a gear 40 that is meshed with a gear 41 fixed to motor shaft 27 so that rotation of motor shaft 27 causes flagpole 16 to rotate, with pole 16 rotating in direction F so as to loosely furl flag 30 about fixed inner pole 12 through slot 22 when cable 24 draws flag 30 downwards.

Slot wall 45 of pole 16 is formed with a lip 46 projecting into the interior chamber 47 between poles 12 and 16 with slot wall 45 serving as the trailing edge of slot 22 so as to engage an outer edge of a furled section of flag 30 to cause the flag to project through slot 22 when the pole 16 rotates in direction U as the cable 24 draws flag 30 upwards.

A control unit 50 fitted with a moisture sensor MS and a light sensor LS and is electrically connected to motor 28, to a supply voltage and to normally closed electrical limit switches ST and SB mounted in housing 11.

Switches ST and SB are located so that a detent 63 fixed to cable 24 opens the contacts of normally closed switch ST when the flag is in the fully extended position and a detent 64 fixed to cable 24 opens the contacts of normally closed switch SB when the flag is in the fully unfurled condition.

The schematic diagram of FIG. 4 indicates the circuitry with alternating current supply voltage fed to a rectifier 71 for supply of direct voltage to the moisture sensor MS and light sensor LS. Under conditions of rain or mist, moisture sensor opens associated normally closed contacts MS-1 and closes normally open contacts MS-2, with light sensor under condition of daylight closing normally open contact LS-1 and opening normally closed contact LS-2 so that under condition of daylight in clear weather relay coil RB is energized to close relay contacts RB-1 and RB-3 and to open relay contact RB-2 to cause relay coil RA to close relay contact RA-1 and to operate motor 28 in the direction to cause the flag to rise and to unfurl until normally closed contacts of switch ST open after cable 24 has drawn the flag 30 to the top of the pole.

Under conditions of insufficient daylight or of moist weather, relay contact MS-2 and LS-2 cause relay RC to close normally open contacts RC-1 and RC-2 and to open normally closed contact RC-3 so as to close relay RA and energize motor 28 to rotate in the opposite direction until normally closed switch contacts SB are opened when the flag is fully lowered and furled.

Motor 28 is a conventional direct current permanent magnet motor the rotation of which is reversed by reversal of the polarity of its supply conductors.

Manually operated switches 81 and 82 may be alternately employed to raise or lower the flag as desired independently of the automatic controls with each switch 81, 82 having two sets of contacts 81A, 81B and 82A, 82B as shown.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A flagpole assembly fitted with motorized means for both raising and lowering of an attached flag and motorized means for furling the attached flag about the column to which the motorized means are fixed, comprising a first hollow column concentrically mounted inside a second hollow column with motorized cable means fitted inside the first column and motorized rotation means mounted to the second column, both said columns formed with slots substantially along their length.

* * * * *